US006888293B2

(12) United States Patent
Roessler et al.

(10) Patent No.: US 6,888,293 B2
(45) Date of Patent: May 3, 2005

(54) PROTECTIVE COATING FOR IGNITION DEVICE

(75) Inventors: Manfred Roessler, Stuttgart (DE); Klaus Hrastnik, Stuttgart (DE); Thomas Jaeger, Erdmannhausen (DE); Christoph Brehm, Bamberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/364,600

(22) Filed: Feb. 11, 2003

(65) Prior Publication Data

US 2003/0184201 A1 Oct. 2, 2003

(30) Foreign Application Priority Data

Feb. 12, 2002 (DE) ..... 102 05 751

(51) Int. Cl.[7] ..... H01T 13/00
(52) U.S. Cl. ..... 313/118; 313/141
(58) Field of Search ..... 313/118, 141

(56) References Cited

U.S. PATENT DOCUMENTS 6,452,314 B1 * 9/2002 Boehler ..... 313/141

FOREIGN PATENT DOCUMENTS

| | | | | |
|---|---|---|---|---|
| DE | 383 98 23 | | 6/1989 | |
| DE | 3626261 | | 7/1989 | |
| DE | 39 06 450 | | 9/1990 | |
| DE | 3841 215 | | 10/1990 | |
| DE | 694 04 730 | | 11/1994 | |
| DE | 195 42 313 | | 6/1996 | |
| DE | 199 40 455 | | 3/2001 | |
| DE | 100 32 186 | | 1/2002 | |
| JP | 2001181856 A | * | 7/2001 | ..... C23C/22/30 |
| WO | WO 01/50559 | | 7/2001 | |

* cited by examiner

*Primary Examiner*—Vip Patel
(74) *Attorney, Agent, or Firm*—Kenyon & Kenyon

(57) ABSTRACT

An ignition device, particularly a spark plug for internal combustion engines, permits improved corrosion protection. The ignition device includes an electrical connector and a tubular, metallic housing having a screw-in thread imprinted on it. At least one of the metallic components of the ignition device is provided at least partially with a protective coating made of a zinc/nickel alloy.

10 Claims, 2 Drawing Sheets

PROTECTIVE COATING FOR IGNITION DEVICE

BACKGROUND INFORMATION

From German Patent No. 199 40 455, an ignition device is already known which includes an electrical connection means and a tubular, metallic housing having a screw-in thread imprinted on it.

SUMMARY OF THE INVENTION

The ignition device of the present invention has the advantage that at least one of the metallic components of the ignition device is at least partially provided with a protective coating of a zinc/nickel alloy. In this way, the protection of the metallic components against corrosion may be substantially improved compared to pure zinc or nickel protective coatings. In addition, it is possible to realize thin coating thicknesses in the range between approximately 5–15 $\mu$m when using the zinc/nickel alloy. Particularly by providing the screw-in thread with the protective coating made of the zinc/nickel alloy, it is possible in this way to adhere to the tolerance range acceptable for the thread dimensions.

Another advantage in using a protective coating made of a zinc/nickel alloy is its excellent adhesion.

A further advantage is increased thermostability of the protective coating made of the zinc/nickel alloy compared to a pure zinc protective coating. In this context, the protective coating made of the zinc/nickel alloy essentially does not lose its ability to protect against corrosion even at high temperatures, at least up to within the range of 350° C. to 400° C.

The protective coating made of the zinc/nickel alloy is also harder and more wear-resistant compared to a pure zinc protective coating.

Thus, during operation in an internal combustion engine, the metallic components of the ignition device may be protected particularly effectively from corrosion and wear at the high temperatures up to approximately 350° C. or 400° C. occurring in the area of the housing, so that the ignition device becomes particularly serviceable and wear-resistant.

It is particularly advantageous if the nickel portion of the alloy lies, for instance, in the range between four percentage by mass and twenty percentage by mass, preferably roughly between ten and fifteen percentage by mass. In this way, the characteristics described may be adjusted particularly well.

A further advantage is that the protective coating is provided at least partially with a passivation, preferably on the basis of trivalent chromium compounds. This makes it possible to increase the corrosion protection of the metallic components of the ignition device.

Another advantage is that the protective coating or the passivation may be provided with a sealing coating, preferably made of organic and/or siliceous constituents. In this way, the anti-corrosion property of the ignition device may likewise be increased.

It is also advantageous that the sealing coating is provided with friction-decreasing constituents. The screwing-in and unscrewing behavior of the ignition device in a cylinder head of the internal combustion engine may thereby be improved.

DETAILED DESCRIPTION

Figure 1:
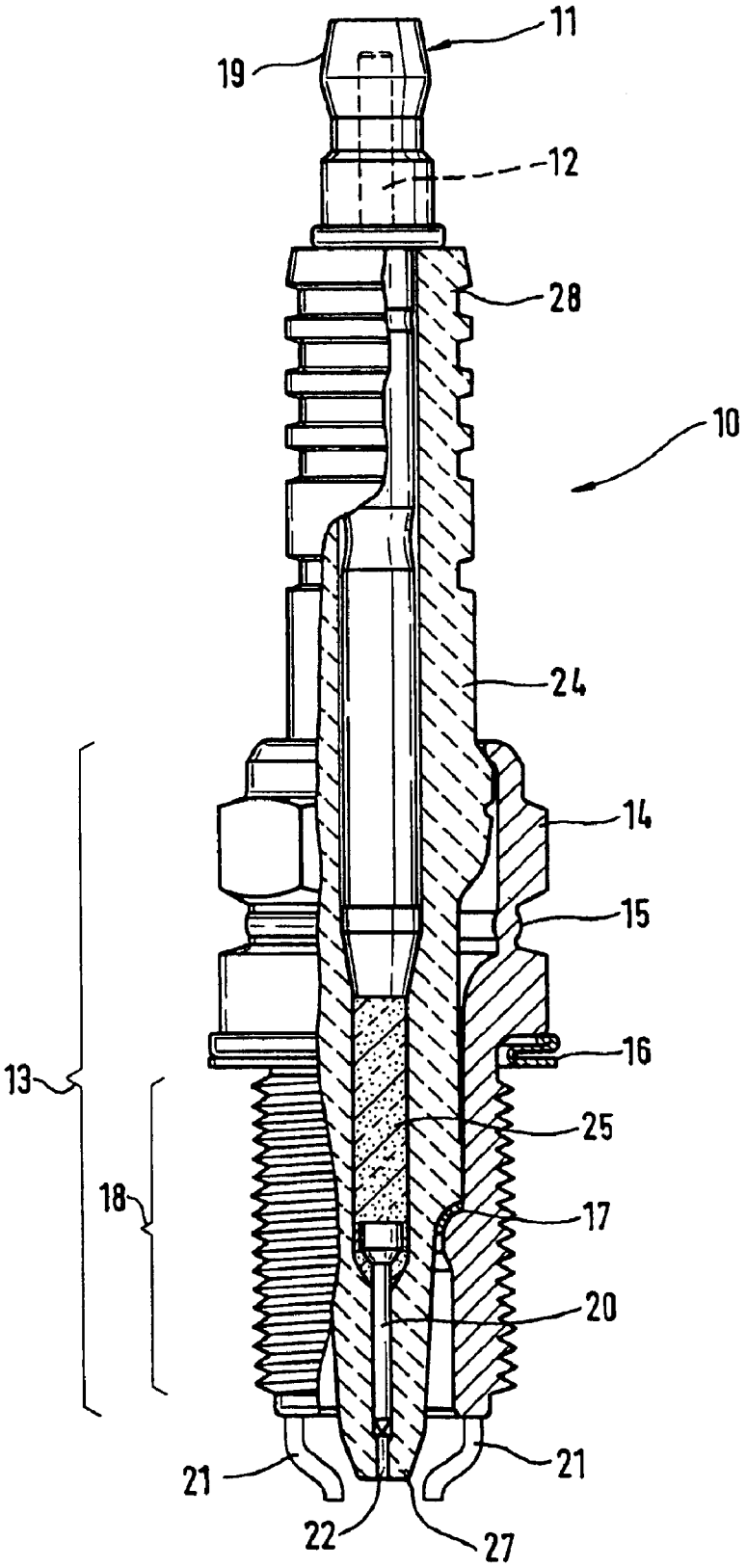
FIG. 1 shows a sectional view of an exemplary embodiment of an ignition device according to the present invention.

In the following, the invention is described by way of example for an ignition device 10 formed as a spark plug. In this context, the design of spark plug 10 described below is likewise by way of example, and may also be implemented in another manner known to one skilled in the art.

Spark plug 10 according to the example here includes a tubular, metallic housing 13 in which a ceramic insulator 24 is disposed. At its end 27 on the combustion-chamber side, insulator 24 sheathes a center electrode 22 and insulates it electrically with respect to housing 13. It likewise contains a contact pin 20 used for transferring voltage to center electrode 22, and a connection means 11 at its terminal-side end 28. Connection means 11 ensures the electrical contacting of center electrode 22 to an external voltage supply (not shown). It essentially includes a terminal stud 12 that is additionally provided at its terminal-side end with a thread and a connecting nut 19. Situated between connection means 11 and contact pin 20 is a burn-off resistor 25 that is made of an electroconductive glass, and that both mechanically anchors the spark-plug components arranged in insulator 24, and also represents a gas-tight seal with respect to the combustion pressure. Between insulator 24 and housing 13 is an inner sealing seat 17 that seals off the interior of spark plug 10 from the combustion chamber.

Up to four ground electrodes 21 are welded on housing 13. The ignition spark is produced between them and center electrode 22. Electrodes 21, 22 are made of a multicomponent alloy having a nickel base and contain, for example, a copper core. However, silver, platinum or platinum alloys may also be utilized as electrode materials.

Housing 13 has on its exterior a hexagon 14 that makes it possible to screw spark plug 10 into an engine block. Also provided is an outer sealing seat 16 that seals off the ambient atmosphere from the combustion chamber. Screw-in thread 18 imprinted on housing 13 is used to anchor spark plug 10 in the engine block.

Adjacent to hexagon 14, housing 13 includes a contraction recess 15. During the process of manufacturing the spark plug, a high voltage of short duration is applied to housing 13. In this way, the contraction recess is heated to temperatures of, for example, approximately 250° C. to 400° C. At the same time, exerted on housing 13 along the longitudinal axis of the spark plug is a high mechanical pressure, under whose effect contraction recess 15 deforms. This process is known as hot pressing and is used to seal the spark plug.

Connection means 11, housing 13 and screw-in thread 18 of spark plug 10 described here are constructed of metal, and thus form metallic components of spark plug 10. Instead of the customarily provided use of electrodeposited zinc or nickel protective coatings, according to the present invention, connection means 11 and/or housing 13 and/or screw-in thread 18 is/are now provided at least partially with a protective coating made of a zinc/nickel alloy. In so doing, metallic components 11, 13, 18 should above all be provided with the protective coating in the part which is particularly susceptible to corrosion and high temperatures, thus, the part facing the combustion chamber of the internal combustion engine. This primarily concerns screw-in thread 18 and, at least partially, housing 13, as well. A comprehensive corrosion protection of metallic components 11, 13, 18 is produced when metallic components 11, 13, 18 are provided as completely as possible with the protective coating. Naturally, this is then also associated with correspondingly higher costs. For example, the protective coating may be applied galvanically to metallic components 11, 13, 18.

To attain the highest possible corrosion protection, high heat resistance and low susceptibility to wear, the nickel component of the zinc/nickel alloy should lie, for instance, in the range between four percentage by mass and twenty percentage by mass, preferably between approximately ten and fifteen percentage by mass. While pure nickel protective coatings act as passive corrosion protection, pure zinc protective coatings possess a cathodic protective action. The zinc/nickel alloy applied according to the invention as a protective coating likewise has a cathodic protective action, but has the advantage of a slow inherent (self) corrosion, and therefore improved corrosion-protection action in comparison to pure zinc protective coatings. Moreover, the zinc/nickel alloy as a protective coating exhibits increased thermostability compared to pure zinc protective coatings, which is a particular advantage for the use of spark plug 10 in the combustion chamber of the internal combustion engine.

In addition, the protective coating made of the zinc/nickel alloy may be provided at least partially with a passivation to increase the corrosion protection of metallic components 11, 13, 18 of spark plug 10 even further. In so doing, it is also possible to again provide metallic components 11, 13, 18 with the passivation in particular where they are facing the engine compartment of the internal combustion engine, in order to save on costs. A passivation is then useful primarily in the region of screw-in thread 18, and also on the parts of housing 13 which are exposed to the engine compartment. To achieve corrosion protection which is increased as completely as possible, metallic components 11, 13, 18 may of course also be provided completely with the passivation. In this context, the passivation may be effected, for example, on the basis of trivalent chromium compounds. These trivalent chromium compounds are, for example, $Cr\ P0_4$, $Cr(OH)_3$, $Cr_2(C0_3)_3$, and hydroxide hydrates such as $Cr(OH)(C0_3)$, also in non-stoichiometric composition. In this way, it is possible to realize a transparent passivation of the protective coating made of the zinc/nickel alloy.

In this context, the passivation may be formed as a thin-layer passivation having a layer thickness of approximately 0.1 $\mu$m. Alternatively, the passivation may be formed as a thick-layer passivation having a layer thickness in the range between roughly 0.5 $\mu$m to 0.9 $\mu$m. The passivation may also contain Zn-compounds such as $Zn\ C0_3$, $Zn(OH)_2$ or $Zn_3(P0_4)_2$.

Furthermore, the protective coating formed from the zinc/nickel alloy may additionally be provided, directly or with passivation applied beforehand, with a sealing coating to further increase the corrosion resistance. In so doing, the sealing coating may again be applied only on those parts of metallic components 11, 13, 18 which are exposed to the engine compartment, and for the remainder, to dispense with the sealing coating for cost reasons. Therefore, applying the sealing coating to screw-in thread 18 and the parts of housing 13 exposed to the engine compartment would again be particularly useful. To realize a complete, increased corrosion protection, metallic components 11, 13, 18 may of course be provided completely with the sealing coating. In this context, the sealing coating may include organic and/or siliceous constituents. For example, organic constituents may be organic resins such as epoxy resins, for instance. The thickness of the sealing coating may lie approximately in the range of 0.5 $\mu$m to a few $\mu$m.

In addition, the sealing coating may be provided with friction-reducing constituents such as PTFE, $MoS_2$, synthetic waxes or also natural waxes. If the sealing coating having the friction-reducing constituents is applied in the area of screw-in thread 18, it is possible to facilitate the screwing of spark plug 10 into or out of the cylinder head of the internal combustion engine.

The protective coating made of the zinc/nickel alloy may be applied on metallic components 11, 13, 18 according to the same method as is already sufficiently known for applying a zinc protective coating.

Correspondingly, the passivation and/or the sealing coating may also be applied using known coating methods. To that end, in the case of the passivation, metallic components 11, 13, 18 are dipped into a suitable aqueous passivation solution. The passivation applied in such a way is no longer water-soluble, so that metallic components 11, 13, 18 may subsequently be freed of excess passivation solution by rinsing, for example, in water. Metallic components 11, 13, 18 are subsequently dried. The protective action of the passivation is first achieved after the drying process. To apply the sealing coating, metallic components 11, 13, 18 are likewise dipped into a suitable aqueous sealing-coating solution. Excess sealing-coating solution is removed by centrifugating or drainage, but not by rinsing. Only after the subsequent drying process is the sealing coating cured, so that it is no longer water-soluble. The protective coating made of the zinc/nickel alloy may be applied, for example, by electroplating.

A tolerance range between approximately 5–15 $\mu$m is provided for the thread dimensions in the region of screw-in thread 18. The protective coating made of the zinc/nickel alloy may be applied on screw-in thread 18 with a coating thickness lying within this permissible tolerance range. Because of the coating thicknesses of the passivation and the sealing coating, respectively, which are less by in part more than the factor 10, there is no departure from the tolerance range for the thread dimensions of screw-in thread 18, even given a combination of the protective coating made of the zinc/nickel alloy, with the passivation and/or the sealing coating.

Figure 2:
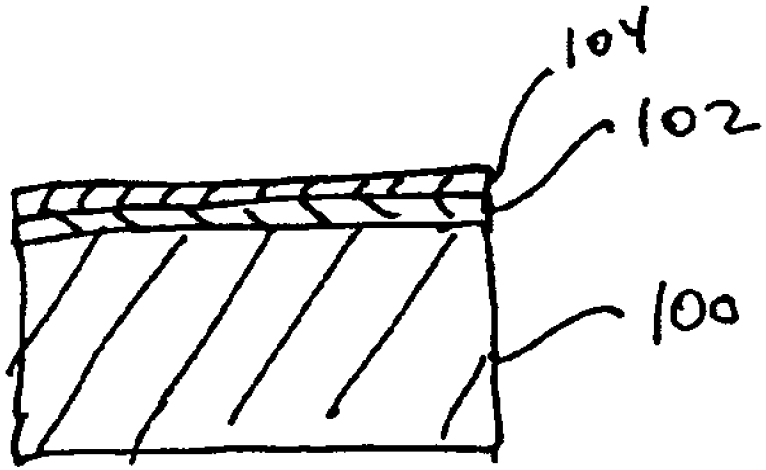
FIG. 2 shows a sectional view of a coating arrangement of an example embodiment of the present invention.

FIG. 2 shows a sectional view of a coating arrangement of an example embodiment of the present invention. In FIG. 2, reference character 100 schematically represents one or more of the metallic components 11, 13, 18, and reference character 102 schematically represents a protective coating and/or a passivation provided on one or more of the metallic components 11, 13, 18, and reference character 104 represents a sealing coating provided on the protective coating and/or the passivation.

What is claimed is:

1. An ignition device comprising:

metallic components including an electrical connector, a tubular metallic housing and a screw-in thread imprinted on the tubular metallic housing, at least one of the metallic components being provided, at least partially, with a protective coating made of a zinc/nickel alloy;

wherein a nickel portion of the alloy lies in a range between 4% and 20% by mass.

2. The ignition device according to claim 1, wherein the ignition device is a spark plug for an internal combustion engine.

3. The ignition device according to claim 1, wherein the nickel portion of the alloy lies in a range between 10% and 15% by mass.

4. The ignition device according to claim 1, further comprising a passivation, on the basis of trivalent chromium compounds, provided on at least a part of the protective coating.

5. The ignition device according to claim 4, wherein the passivation is formed as a thin-layer passivation having a layer thickness of about 0.1 $\mu$m.

6. The ignition device according to claim 4, wherein the passivation is formed as a thick-layer passivation having a layer thickness in a range between about 0.5 $\mu$m and 0.9 $\mu$m.

7. The ignition device according to claim 4, further comprising a sealing coating provided on at least one of the protective coating and the passivation.

8. The ignition device according to claim 7, wherein the sealing coating is made of at least one of organic and siliceous constituents.

9. The ignition device according to claim 7, wherein a thickness of the sealing coating is above about 0.5 $\mu$m.

10. The ignition device according to claim 7, wherein the sealing coating includes friction-reducing constituents.

* * * * *